United States Patent [19]

Alder

[11] 3,960,678

[45] June 1, 1976

[54] ELECTROLYSIS OF A MOLTEN CHARGE USING INCOMSUMABLE ELECTRODES

[75] Inventor: Hanspeter Alder, Flurlingen, Switzerland

[73] Assignee: Swiss Aluminium Ltd., Chippis, Switzerland

[22] Filed: May 15, 1974

[21] Appl. No.: 470,198

[30] Foreign Application Priority Data

May 25, 1973 Switzerland ..... 7522/73

[52] U.S. Cl. ..... 204/67; 204/243 R; 204/245; 204/246; 204/284; 204/290 R; 204/291; 106/39.5

[51] Int. Cl.[2] ..... C25C 3/06; C25C 3/12; C05B 35/00

[58] Field of Search ..... 204/67, 290 R, 243 R, 204/247, 291, 284

[56] References Cited

UNITED STATES PATENTS

| | | | |
|---|---|---|---|
| 3,428,545 | 2/1969 | Johnson | 204/243 R X |
| 3,459,515 | 8/1969 | Bergmann | 204/291 X |
| 3,718,550 | 2/1973 | Klein | 204/291 X |
| 3,814,699 | 6/1974 | Baldieri et al. | 204/290 R |
| 3,829,374 | 8/1974 | Kugler et al. | 204/290 R |

*Primary Examiner*—T. Tung
*Assistant Examiner*—Aaron Weisstuch
*Attorney, Agent, or Firm*—Ernest F. Marmorek

[57] ABSTRACT

Process for operating a cell for the electrolysis of a molten charge, in particular aluminum oxide, with one or more anodes, the working surfaces of which are of ceramic oxide material, and anode for carrying out the process.

In the process a current density above a minimum value is maintained over the whole anode surface which comes into contact with the molten electrolyte. An anode for carrying out the process is provided at least in the region of the interface between electrolyte and surrounding atmosphere, the three phase zone, with a protective ring of electrically insulating material which is resistant to attack by the electrolyte. The anode may be fitted with a current distributor for attaining a better current distribution.

10 Claims, 9 Drawing Figures

ELECTROLYSIS OF A MOLTEN CHARGE USING INCOMSUMABLE ELECTRODES

Figure 1:
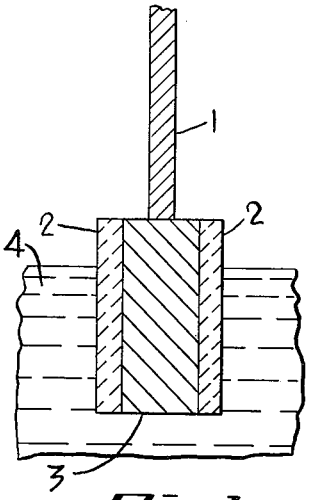

The invention relates to a process and a device for the electrolysis of a molten charge using inconsumable electrodes, in particular for the production of aluminum with a purity of more than 99.5 %.

In the electrolytic production of aluminum by the Hall-Heroult process a cryolite melt with $Al_2O_3$ dissolved in it is electrolysed at 940°–1000°C. The aluminum which separates out in the process collects on the cathodic carbon floor of the electrolysis cell whilst $CO_2$ and to a small extent CO are formed at the carbon anode. The anode is thereby burnt away.

For the reaction $$Al_2O_3 + 3/2\ C \rightarrow 2\ Al + 3/2\ CO_2$$

this combustion should in theory consume 0.334 kg C/kg Al; in practice however, up to 0.5 kg C/kg Al is consumed.

The burning away of the anodes has a number of disadvantages viz.,

In order to obtain aluminum of acceptable purity a relatively pure coke with low ash content has to be used as anode carbon.

Pre-baked carbon anodes have to be advanced from time to time in order to maintain the optimum inter-polar distance between the anode surface and the surface of the aluminum.

Periodically the pre-baked anodes when consumed have to be replaced by new ones. Söderberg anodes have to be repeatedly charged with new material.

In the case of pre-baked anodes a separate manufacturing plant, the anode plant, is necessary.

It is obvious that this process is laborious and expensive. The direct decomposition of $Al_2O_3$ to its elements viz., $$Al_2O_3 \rightarrow 2\ Al + 3/2\ O_2$$

using an anode where no reaction with the oxygen takes place is therefore of greater interest.

With this method, oxygen, which can be re-used industrially, is released, and the above mentioned disadvantages of the carbon anodes also disappear. This anode is particularly favourable for a sealed furnace, the waste gases of which can be easily collected and purified. This furnace can be automated and controlled from outside, leading therefore to an improvement in the working conditions and a reduction of problems related to the pollution of the environment. The demands made on such an anode of inconsumable material are very high. The following conditions must be fulfilled before this anode is of interest from the technical point of view.

1. It must be thermally stable up to 1000°C.
2. The specific electrical resistivity must be very small so that the voltage drop in the anode is a minimum. At 1000°C the specific resistivity should be comparable with, or smaller than that of anode carbon. The specific resistivity should also be as independent of temperature as possible so that the voltage drop in the anode remains as constant as possible even when temperature changes occur in the path.

3. Oxidising gases are formed on the anode, therefore the anodes must be resistant to oxidation.
4. The anode material should be insoluble in a fluoride or oxide melt.
5. The anode should have adequate resistance to damage from temperature change so that on introduction into the molten charge or when temperature changes occur during electrolysis it is not damaged.
6. Anode corrosion should be negligibly small. If nevertheless some kind of anode product should enter the bath, then neither the electrolyte, the separated metal, nor the power output, should be affected.
7. On puttig the putting into service in the industrial production of aluminum they must
   be stable when in contact with the liquid aluminum which is suspended in the electrolyte,
   have no influence on the purity of the aluminum obtained,
   operate economically Obviously the number of materials which even approach fulfilling these extremely severe criteria is very limited. Only ceramic oxides come into consideration.

In the Swiss Pat. No. 520,779 an anode made of ceramic oxide material, in particular 80–99 % $SnO_2$, is described. Further tests however have shown that this anode described is problematic in that it shows a certain amount of loss and as a result of this the aluminum obtained amongst other things is made impure by the inclusion of tin which in most cases is undesirable.

Subsequently the applicant learned that the possibility of using such a material as anode material for the electrolytic production of aluminum had been recognised earlier by A.I. Belyaev (Chem. Abstr. 31, (1937), 8384 and 32 (1938), 6553).

The author analysed the aluminum precipitated and the results show that he also obtained an impure grade of metal.

| Anode | Analysis of Aluminum |
|---|---|
| $SnO_2.Fe_2O_3$ | Sn 0.80 % Fe 1.27 % |
| $NiO.Fe_2O_3$ | Ni 0.45 % Fe 1.20 % |
| $ZnO.Fe_2O_3$ | Zn 2.01 % Fe 2.01 % |

Furthermore it must be said of this experiment:

the high level of impurity caused by the metal from the anode makes the aluminum uninteresting from an economic stand-point and shows that the ceramic anodes are quite substantially consumed.

the anodes described have a specific resistivity which is some orders of magnitude greater than that of anode carbon.

The publications therefore do not demonstrate that the use of ceramic oxide anodes would be an advantage in the industrial electrolysis of aluminum, but rather the opposite of this.

The applicant found that the pronounced corrosion of the anode stems from two causes viz., in the molten electrolyte there is always a suspension of aluminum which enters into an aluminothermic reaction with the $SnO_2$.

the anode material is particularly susceptible to corrosion in the three phase boundary between anode, electrolyte and the surrounding atmosphere.

An object of the invention is to provide a process for operating a cell for the electrolysis of a molten charge, in particular aluminum oxide, using one or more anodes with working surfaces of ceramic oxide materials, by which process the anodes are to a great extent protected from damage by corrosion, in particular at the three phase boundary. A further object of the invention is to provide an anode for performing the said process.

In the process according to the invention a current density above a minimum value is maintained over the whole of that part of the anode surface dipping into the melt and which is not protected with an electrically insulating material which is resistant to attack by the electrolyte.

An anode according to the invention for performing this process is provided, at least in the region of the interface between the electrolyte and the surrounding atmosphere, with a protective ring of an electrically insulating material which is resistant to attack by the electrolyte.

Ceramic oxide anodes permit high average current densities which can be raised as high as 5 A/cm$^2$. In the case of $SnO_2$ anodes the optimum average current density lies between 1 and 3 A/cm$^2$, preferably between 1.5 and 2.5 A/cm$^2$. On the other hand the carbon anode reaches its optimum at 0.85 A/cm$^2$, higher current densities being disadvantageous.

Thanks to the higher electrical loading which can be borne by the ceramic anodes a greater quantity of aluminum can be produced in less space and in a shorter period of time.

The anode in accordance with the invention makes use, to some extent, of materials which are already known, however ways had to be found to make these materials useable on an industrial scale. The following main points differentiate the anode of the invention from previously described inconsumable anodes viz., that the aluminum produced with it completely corresponds to a reduction plant grade i.e. a purity of more than 99.5 % can be achieved.

the consumption of the anode is practically zero.

the specific electrical resistivity attainable can be that of carbon.

Base materials for the anode are $SnO_2$, $Fe_2O_3$, $Fe_3O_4$, $Cr_2O_3$, $Co_3O_4$, NiO or ZnO, preferably 80–99.7 % $SnO_2$.

Tin oxide has the following advantages:

little sensitivity to thermal shock very low solubility in cryolite (0.08 % at 1000°C)

On the other hand, without additives, $SnO_2$ can not be made into a densely sintered product and it exhibits a relatively high specific resistivity at 1000°C. Additions of other oxides in a concentration of 0.01–20 %, preferably 0.05–2 % have to be made in order to improve such properties of pure tin oxide.

To improve the sinterability, the compactness and the conductivity of the $SnO_2$, additions of one or more of the oxides of the following metals are found to be useful: Fe, Cu, Mn, Nb, Zn, Co, Cr, W, Sb, Cd, Zr, Ta, In, Ni, Ca, Ba, Bi.

In the manufacture of ceramic oxide bodies of this kind known processes of ceramic technology can be employed. The oxide mixture is ground, given the desired shape by pressing or by casting a slurry into a mould, and then sintered at a high temperature. Besides that, the oxide material can also be deposited on a substrate for example by flame spraying or plasma spraying. The ceramic body may have any desired shape, however plates or cylinders are preferred.

The molten electrolyte can, as in normal practice, consist of fluorides, in particular cryolite, or of a known mixture of oxides, as can be found in technical literature.

On applying the ceramic anode to the electrolysis of aluminum, the anode must on the other hand be in contact with a molten charge and on the other hand be connected to a power supply. The discharging of the $0^{-2}$ ions takes place at the interface between the molten charge and the ceramic, and the oxygen which forms escapes through the molten charge.

It has been found that if a ceramic body of $SnO_2$, for example a cylinder, is dipped into the cryolite melt of a cell for the electrolytic production of aluminum, without carrying a current, than the tin oxide starts to be removed rapidly. Since experience has shown that tin oxide is resistant to attack by pure cryolite, it appears that a reaction takes place with the aluminum suspended and dissolved in the cryolite, viz., $$3\ SnO_2 + 4\ Al \rightarrow 3\ Sn + 2\ Al_2O_3$$

A similar behaviour is found with differently composed electrolytes which also contain a suspension of aluminum.

It has now been found that the corrosion can be significantly reduced if the whole anode surface which comes into contact with the molten electrolyte carries a electrical current density greater than a minimum value. Thereby the minimum current density is 0.001 A/cm$^2$, advantageously 0.01 A/cm$^2$, preferably 0.025 A/cm$^2$. This means that the current density must not fall below these values at any place on the anode surface in contact with the melt. This can be achieved by suitable cell-parameters, especially with regard to the voltage applied and the shape and arrangement of the electrodes.

In the case of an anode partly immersed in the molten electrolyte the consumption can however, still be very noticeable and in particular occurs in two places viz., on the bottom face of the anode and at the three phase zone. By "three phase zone" is to be understood that part of the anode at the level of the interface between the molten electrolyte and the surrounding atmosphere. It turns out that in many cases the corrosion at the three phase zone is greater than on the bottom face of the anode.

In order to explain this phenomenon the following assumptions are made:

the cylindrical anode of ceramic oxide is surrounded by a concentric graphite cathode at a distance *a*.

the floor of the graphite cathode runs parallel to the bottom surface of the anode at a distance *b*.

the resistance of the salt bath between the three phase zone and the concentric cathode is $R_a$.

the resistance of the salt bath between the bottom surface of the anode and the parallel cathode surface is $R_b$ the resistance in the ceramic between the three phase boundary and the bottom surface of the anode is $R_i$.

The specific resistance of the salt bath and the interface resistances anode / salt bath and salt bath / cathode are all assumed to be equal.

Case 1: $R_a < R_b + R_1$

This occurs apparently when $b>a$; but also occurs when $b<a$ if the conductivity of the anode is poor by comparison with that of the bath. In such cases the main part of the current enters the cryolite bath in the three phase zone. The bottom surface of the anode then remains practically without current and is exposed to attack by the aluminum in suspension.

Case 2: $R_a > R_b + R_i$

This can only occur if $b<a$ and if the conductivity of the anode is good by comparison with that of the bath. In such a case the main part of the current does not flow out of the ceramic body until its end i.e. the bottom surface. The three phase zone is practically without current and is exposed to attack by the aluminum in suspension.

Therefore, depending on the resistance of the ceramic as compared with the resistance of the bath, the different events can take place in the three phase zone:

- a high local current density may occur, leading, in conjunction with other parameters, to pronounced corrosion.
- the current density may fall below the minimum values thus exposing the three phase region to attack by the aluminum in suspension.

Additionally, in both cases the oxygen formed and the vapour of the molten charge leave the bath at the three phase zone leading to a localised turbulence, probably producing accelerated corrosion of the anode.

The corrosion of the anode is avoided by taking measures which guarantee a minimum current density over the whole of the anode surface exposed to the melt, and further measures for protecting the anodes from attack at the three phase zone.

Therefore according to a further feature of the invention the side walls of the ceramic oxide anode are provided, at least in the region of the electrolyte surface, with a poorly conducting coating which is resistant to attack by the molten electrolyte.

This coating may be of two kinds, viz.,

- the sides of the anode are shielded by providing a pre-shaped covering consisting preferably of a well sintered dense $Al_2O_3$, electromelted MgO, or possibly refractory nitrides, such as boron nitride.
- the sides of the ceramic anode can be completely or partly covered by forming a crust of solidified electrolyte material from the charge on the anode sides. The formation of the crust can, in those cases where it is necessary, be brought about by localised cooling.

With both of these methods, either separate or combined, it is also possible to achieve a uniform current density over the immersed unprotected anode surfaces.

In combination with the protection of the three phase boundary an improved uniform distribution of current in the anode body is obtained if a good electrical conductor is built into the anode. This conductor can be a metal, preferably Ni, Cu, Co. Mo or molten silver, or a non-metallic material such as carbides, nitrides or borides, which conducts at the operating temperature of the anode. Power leads and distributors can possibly be made of the same material and can be produced out of a single piece. The power distributor must not react with the ceramic material at the operating temperature e.g. at 1000°C.

Figure 4:
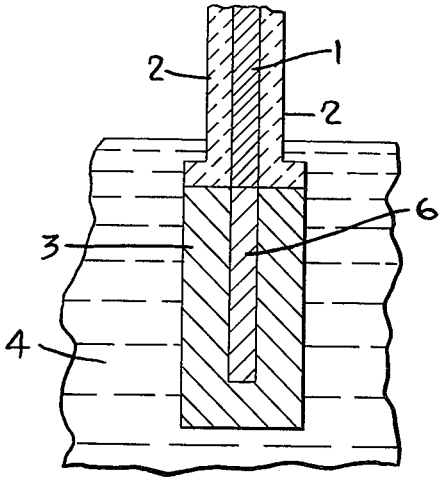
Figure 5:
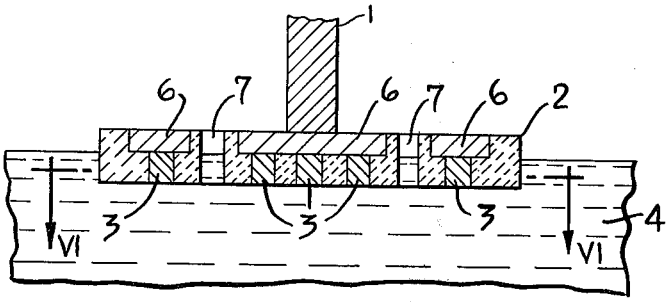
Figure 6:
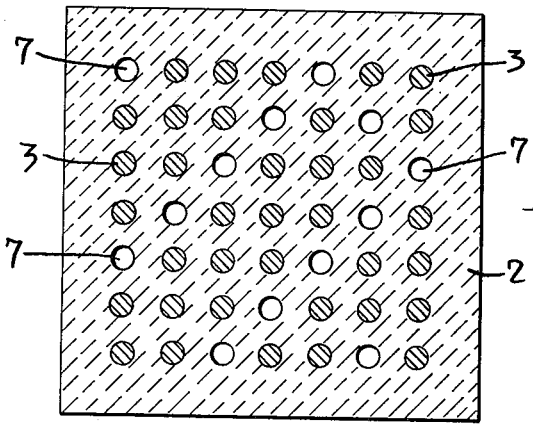

Various embodiments of the inconsumable electrodes in accordance with the invention and electrolytic cells fitted with these electrodes are presented schematically and shown in vertical sections in FIGS. 1–5 and 7–9 and in a horizontal section in FIG. 6.

The figures show:

FIG. 1. A ceramic oxide anode with sides completely shielded

Figure 2:
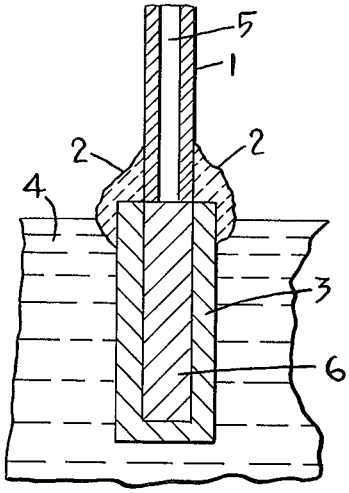

FIG. 2. A ceramic oxide anode with sides partly shielded by solidified electrolytic material.

Figure 3:
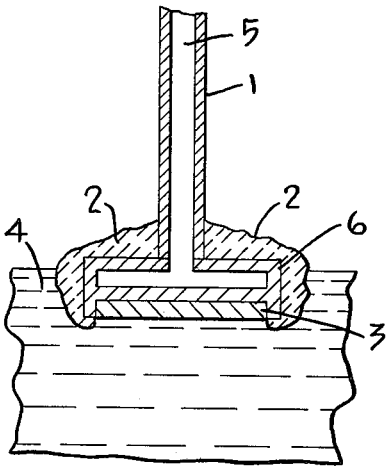

FIG. 3 An anode with bottom plate of ceramic oxide and having the side walls completely shielded with a crust.

FIG. 4. An anode with ceramic oxide body completely immersed in the electrolyte, and showing the shielded power supply lead.

FIG. 5 A horizontal plate-shaped anode with individual ceramic oxide anode blocks.

FIG. 6 A horizontal section VI–VI of the embodiment shown in FIG. 5.

Figure 7:
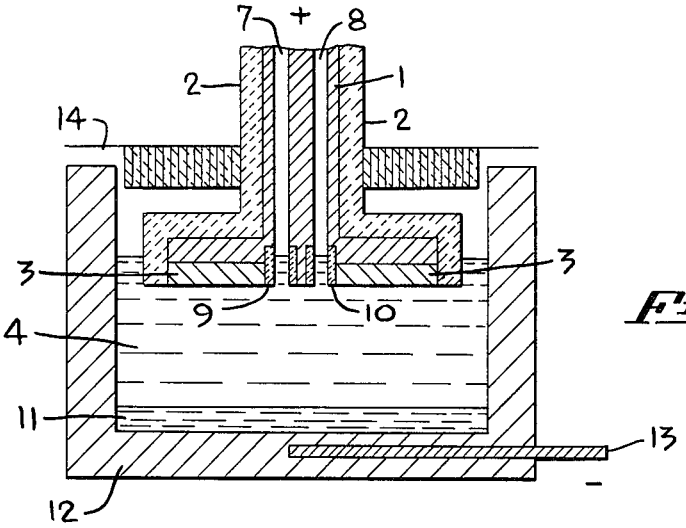

FIG. 7. An electrolytic cell with a horizontal anode.

Figure 8:
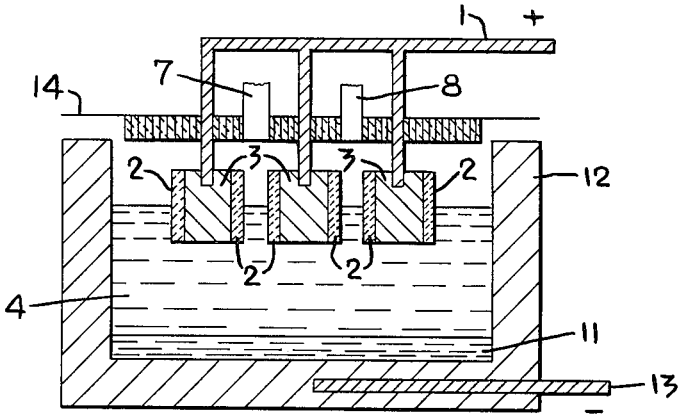

FIG. 8. An electrolytic cell with several anodes.

Figure 9:
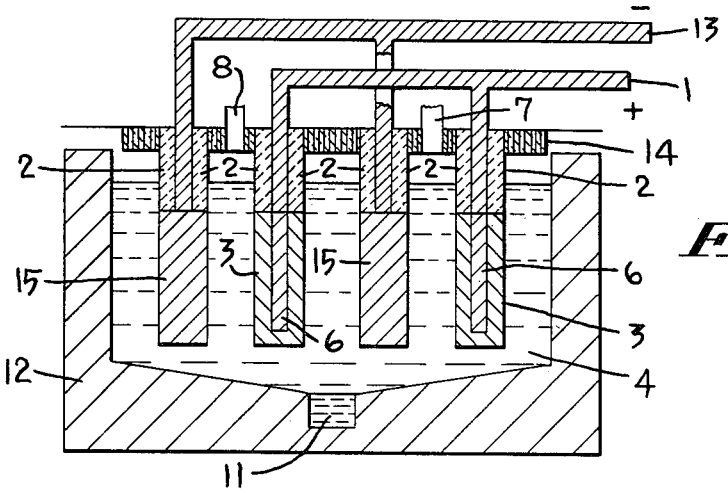

FIG. 9. Electrolytic cell with multiple anodes and cathodes alternately arranged.

In all figures the part leading the power to the anode is indicated by the number 1. It is made of metal or another electron conductive material such as a carbide, nitride or boride. The protective layer 2 on the anode 3 is made of a poorly conducting material which is resistant to attack by the molten electrolyte. The ceramic oxide anode 3 consists, advantageously, of doped $SnO_2$ and is at least partly in contact with the electrolyte 4.

In the embodiment shown in FIG. 1, the protective layer 2 on the cylindrically shaped anode 3 of ceramic oxide material, is a ring of electrically melted $Al_2O_3$ or MgO which has been prefabricated and bonded, or sprayed onto the anode surface before immersing the anode in the melt. This protective ring completely covers the sidewalls of the ceramic anode 3 which is only partly immersed in the molten electrolyte 4. In this way a mainly uniform distribution of current is obtained on the exposed bottom face which is immersed in the molten electrolyte.

It is, however, not necessary that the protective ring cover the whole of the side wall area; it may be also be less extensive but must protect that part in the three phase zone.

In FIG. 2 the protective ring 2 is formed by the solidification of electrolyte whereby this crust can form with sufficient thickness under favourable thermal conditions. This crust formation can, if necessary, be formed by passing a coolant through a channel 5 in the conductive lead 1. A built-in current distributor 6 lowers the internal resistance of the anode and can help to attain as uniform as possible current distribution over the unprotected, immersed anode surface. The current distributor can as shown consist of a solid body down the centre of the anode. It can equally well be arranged in the region hear the anode surface, for example, as a wire netting.

In FIG. 3 the protective layer 2 is likewise formed out of solidified electrolytic material. The cooling system 5 is however so constructed that also the side walls which are formed by the current distributor 6 can be cooled. Only the base plate 3, surrounded by the current distributor, consists of ceramic oxide material and has its uncovered lower face directly in contact with the molten electrolyte.

In the embodiment shown in FIG. 4 the ceramic oxide body 3 is completely immersed in the molten electrolyte. The power lead 1 and the upper face have been previously provided with a protective ring 2. A current distribution which is as uniform as possible is aimed for by using a current distributor 6.

FIGS. 5 and 6 show a horizontal anode plate. The individually produced anode blocks of ceramic oxide are embedded in an insulating, electrolyte-resistant support plate 2 and are in contact with a current distributing plate 6. The uniformly spaced holes 7 in the support plate allow the gases which develop at the anode to escape from the electrolyte. In a variation of the embodiment shown in FIG. 5 the ceramic anodes can project out of the lower face of the support plate.

FIG. 7 shows an electrolytic cell with a horizontal anode having channels in the middle to allow oxygen to be released and to allow $Al_2O_3$ to be added. The side walls of the anode and the conductive lead 1 have been provided with a protective layer 2 to prevent corrosion at the three phase boundary. In the channel 7 for release of oxygen and in channel 8 for addition of $Al_2O_3$, a three phase boundary is formed because of the presence of the molten electrolyte. In order to prevent damage due to corrosion, the lower part of each channel is fitted with inserts 9 and 10 of the same materials as the protective layer 2. The layer 11 of liquid aluminum which separates out and which at the same time serves as the cathode of the electrolysis cell, is collected in the trough 12 which can be made of carbon, graphite or electron conductive carbides, nitrides or borides which are resistant to the molten electrolyte. The power supply of the cathode 13 is situated in the floor of the trough of the electrolysis cell. The electrolytic cell is closed with a top 14 which is covered with refractory insulating blocks.

FIG. 8 shows an electrolytic cell with several anodes which may be constructed as shown in any of the previous figures and which have a common cathode 11 of liquid aluminum.

The cell shown in FIG. 9 has a number of anode and cathode plates alternately arranged, both sides of which, with the exception of the end electrodes, are used for the passage of current. The power supplies for the anodes 1 and the cathodes 13 are shielded with a protective layer 2 in the area of the three phase boundary. The ceramic oxide anode plates 3 are provided with a current distributor 6. The cathodes 15 are made of carbon, graphite or an electron conductive carbide, nitride or boride which is also resistant to attack by the molten electrolyte. The liquid aluminum 11 which separates, collects in a channel. The trough 12 of this cell does not function as cathode and can therefore also be made out of an insulating material.

In the following examples, $SnO_2$ samples made substantially as described in example 1, are doped with various metal oxides and their application as anodes in the electrolysis of aluminum is investigated.

The cylindrical sample is secured near the front face between two "Thermax" steel holders with semi-circular recesses. The steel holder/sample contact surface areas are each about 1 $cm^2$. These holders are fixed on a Thermax rod of 0.7 cm diameter.

The Thermax then serves not only to hold the sample but also to lead the power to the sample.

The sample is dipped in molten cryolite at 960°–980°C contained in a graphite crucible which is 11 cm deep and has an inner diameter of 11 cm. The cryolite is 6 cm deep. The graphite crucible serves as cathode whilst the sample is used as anode. The electrolysis cell is heated externally by four hot plates 34 cm long and 22 cm broad with a total heating capacity of 3.6 kW.

At the end of the experiment the anode is taken out of the bath and cooled. The amount of anode material removed is then measured with respect to the cross section in the lower part, the total length, and the three phase boundary i.e. the position where the anode is simultaneously in contact with the cryolite and the gas phase consisting of electrolyte vapours and discharged oxygen.

The following calculations are made:

current density over the cross section of the anode $$\text{Current density } (A/cm^2) = \frac{\text{Total current } (A)}{\text{Cross sectional area of anode } (cm^2)} \quad (1)$$

Aluminum produced $$\text{Aluminum (g/h)} = \frac{\text{Total current } (A)}{2.98\ Ah/g \text{ aluminum}} \quad (2)$$

It is assumed then that the current yield is 100 %. For small scale experiments in the laboratory this is however by far not the case: re-oxidation and the long period until the cell reaches equilibrium prevent such a high yield.

Corrosion of the Anode

The corrosion of the anode is determined at the end of the test by measuring the anode with sliding calipers (error margin 0.1 mm). From this the reduction in volume, in $cm^3$ of $SnO_2$ per hour, is calculated. As an extreme case it is assumed that all the $SnO_2$ which is removed from the bottom face and three phase boundary is reduced to metallic tin either electrolytically or chemically, and goes into the metallic aluminum.

$$\text{Tin precipitated (g/h)} = \underset{(cm^3/h)}{SnO_2 \text{ removed}} \cdot \underset{(g/cm^3)}{\text{Anode density}} \cdot \frac{\text{Atomic weight Sn}}{\text{Molecular weight } SnO_2} \quad (3)$$

Analyses have shown however that the calculated tin contents of the aluminum are much too high; in particular with small degrees of corrosion of the anode, the inaccuracy of the sliding calipers is an important factor.

EXAMPLE 1

Tin oxide with the following properties was used as base material in preparation of samples:

Purity: > 99,9 %

True Density: 6,94 $g/cm^3$

Particle size: < 5 microns

About 500 g of a mixture of base and doping material were dry ground in a mixer for 10 minutes. 250 g of this mixture were poured into a cylindrical "Vinamold" flexible mold and compressed manually with a steel cylinder. The filled mould was placed in the pressure chamber of an isostatic press. The pressure was raised from 0 to 2000 $kg/cm^2$ in 3 minutes, kept at maximum for 10 seconds and then reduced again to zero in a few seconds. The non-sintered "green" sample was taken out of the mould and polished.

The green-pressed sample was then transferred to a furnace with molybdenum silicide heating elements where it was heated from room temperature to 1250°C over a period of 18 hours, kept at this temperature for 5 hours and then cooled to 400°C during the following 24 hours. After reaching this temperature the sintered sample was taken out of the furnace and after cooling to room temperature was weighed, measured and the density calculated.

The percentage true density of the sample was then calculated using the relationship between true and measured densities:

$$\% \text{ True density} = 100 \frac{\text{Density of the Sample}}{\text{True density}}$$

A series of sintered $SnO_2$ ceramic samples was produced in this way. The object of making the various additions was to achieve the highest possible density and a low specific resistance by the minimum doping. Furthermore it is desireable that the specific resistance of the ceramic exhibits the least possible dependence on temperature.

The results have been summarised in table I, the quantitative composition of the anodes being given in weight percent.

The results show that a very high effective density can be achieved with various compositions.

The table also gives information about the specific resistivity at 20° and 1000°C.

It is proved that the desired aim is achieved in particular with additions of 0.5–2 % $Sb_2O_3$ and 0.5–2 % CuO either alone or combined. The system $SnO_2$ + 2% CuO + 2% $Sb_2O_3$ is particularly favourable in particular with regard to the low temperature dependence of the specific resistance. With such a ceramic anode the cell can be run at a lower temperature and can be heated to the normal temperature by the electrolysis process itself.

TABLE I-continued

| Ceramic Anode | % true density | Specific Resistance (ohm.cm) 20°C | 1000°C |
|---|---|---|---|
| $SnO_2$ + 0.1% $MnO_2$ | 65 | $1.7 \cdot 10^6$ | 11 |
| $SnO_2$ + 0.3% $MnO_2$ | 98 | | 0.1 |
| $SnO_2$ + 2% $Nb_2O_5$ | 96 | $\sim 10^4$ | 0.004 |
| $SnO_2$ + 0.5% ZnO | 99 | $4.2 \cdot 10^5$ | 1.8 |
| $SnO_2$ + 1% ZnO | 99 | $5 \cdot 10^5$ | 0.9 |
| $SnO_2$ + 2% ZnO | 99 | $7 \cdot 10^6$ | 0.35 |
| $SnO_2$ + 2% $Cr_2O_3$ | 68 | $1.8 \cdot 10^6$ | 61 |
| $SnO_2$ + 5% $Co_3O_4$ | 95 | $7.5 \cdot 10^5$ | 0.6 |
| $SnO_2$ + 2% $WO_3$ | 67 | $2.4 \cdot 10^4$ | 3.1 |

EXAMPLE 2

The starting material for the ceramic oxide was a mixture of 98% $SnO_2$ and 2% $Fe_2O_3$. The $Fe_2O_3$ used for doping had the following properties:

| | |
|---|---|
| Purity | 99 % |
| True Density | 4.87 g/cm³ |
| Particle size | ≅ 20 microns |

The anodes produced by the process described in Example No 1 had a specific resistance of 4 ohm-cm at 1000 °C.

These anodes which had no protection at the three phase zone were dipped into a melt of the following composition to a depth of 3 cm:

| | |
|---|---|
| Cryolite | 1105 g = 85 % |
| Alumina | 130 g = 10 % |
| $AlF_3$ | 65 g = 5 % |

The molten cryolite was put in the crucible on top of 100 g of liquid aluminum in order to simulate as closely as possible the conditions of electrolysis during which the electrolyte is saturated with aluminum.

Experimental parameters and data obtained are presented in table II.

TABLE II

| | |
|---|---|
| Anode: | $SnO_2$ + 2% $Fe_2O_3$, sintered at 1200 – 1250°C, for 5 h |
| True density: | 6,88 g/cm³ |
| Cryolite melt: | 1105g $Na_3AlF_6$ + 65g $AlF_3$ + 130g $Al_2O_3$, 960 – 980°C, over 100g of molten Al |
| Depth of anode in melt: | 3 cm |

| Anode (No) | Bottom face Surface Area (cm²) | Length (cm) | Apparent density (g/cm³) | % of true density | Duration of experiment (h) | Current (A) | Current density (A/cm²) | Aluminum (g/h) | Corrosion of bottom $SnO_2$ (cm³/h) | Corrosion of bottom Sn (g/h) | Corrosion at the 3-phase zone $SnO_2$ (cm³/h) | Corrosion at the 3-phase zone Sn (g/h) | Total Corrosion Sn (g/h) | Proportion at the 3-phase zone (%) | Sn content of the Al (calculated) (%) |
|---|---|---|---|---|---|---|---|---|---|---|---|---|---|---|---|
| T-20 | 7,02 | 5,45 | 6,37 | 92,6 | 62 | — | — | — | 0,306 | 1,54 | — | — | 1,54 | — | — |
| 452 | 5,19 | 5,91 | 6,77 | 98,4 | 62,5 | 0,8 | 0,15 | 0,268 | 0,0010 | 0,0056 | 0,00038 | 0,0020 | 0,0076 | 26,3 | 2,75 |
| 467 | 3,05 | 5,02 | 6,71 | 97,5 | 63,5 | 1,5 | 0,49 | 0,504 | 0,0002 | 0,0013 | 0,00123 | 0,0065 | 0,0078 | 83,3 | 1,52 |
| 456 | 4,30 | 4,63 | 6,68 | 97,1 | 60,0 | 3,6 | 0,84 | 1,208 | 0,0031 | 0,0165 | 0,0100 | 0,0529 | 0,0694 | 76,2 | 5,43 |
| 455 | 3,94 | 4,47 | 6,67 | 97,0 | 60,0 | 4,7 | 1,19 | 1,576 | 0,0019 | 0,0099 | 0,0115 | 0,0603 | 0,0702 | 85,9 | 4,26 |

TABLE I

| Ceramic Anode | % true density | Specific Resistance (ohm.cm) 20°C | 1000°C |
|---|---|---|---|
| $SnO_2$ | 62 | $1.1 \cdot 10^6$ | 30 |
| $SnO_2$ + 2% $Fe_2O_3$ | 97 | $5 \cdot 10^6$ | 4 |
| $SnO_2$ + 5% $Fe_2O_3$ | 96 | $5.4 \cdot 10^5$ | 1.5 |
| $SnO_2$ + 10% $Fe_2O_3$ | 97 | $3.1 \cdot 10^5$ | 1 |
| $SnO_2$ + 2% $Sb_2O_3$ | 71 | 51 | 0.007 |
| $SnO_2$ + 1% $Sb_2O_3$ + 2% $Fe_2O_3$ | 96 | 8.5 | 0.065 |
| $SnO_2$ + 2% CuO | 98 | 15 | 0.035 |
| $SnO_2$ + 10% CuO | 92 | $6 \cdot 10^3$ | 1.1 |
| $SnO_2$ + 2% CuO + 1% $Sb_2O_3$ | 94 | 5.1 | 0.004 |
| $SnO_2$ + 2% CuO + 2% $Sb_2O_3$ | 95 | 0.065 | 0.0034 |

Table II shows:

a. Anode T-20 was dipped into the cryolite melt containing aluminum, without carrying current. More than 99% of the part of the sample which was immersed in the electrolyte was consumed, the rest is cone shaped. Since tin oxide is stable in contact with cryolite the following reaction must have taken place $$3\ SnO_2 + 4\ Al \rightarrow 3\ Sn + 2\ Al_2O_3 \qquad (5)$$

b. In the case of the anodes 452, 456, 467 and 455 which carried current, corrosion took place in two places viz., at the three phase boundary and on the bottom face. Except in the case of very small current densities the corrosion of the anode occurred preferentially at the three phase zone. Approximately 80 % of the tin content of the aluminum obtained came from the three phase zone. The bottom face is protected from reduction by the aluminum in suspension. The calculated tin content of 1.5–5.5 % in the aluminum is obviously too high for the application of unprotected anodes to be of interest industrially.

c. The drop in potential in the anode can be calculated from the following equation:

$$\Delta V = \rho \cdot \frac{l}{F} \cdot I \qquad (6)$$

$\Delta V$ = Drop in potential (Volt)
$l$ = length of anode (cm) (under current)
F = anode section ($cm^2$)
I = Current (ampere)
$\rho$ = specific resistance (ohm.cm) for $SnO_2$ + 2% $Fe_2O_3$: 4 ohm.cm

TABLE III

| Depth of anode: 3 cm | | | | | |
|---|---|---|---|---|---|
| | | | | Voltage drop | |
| Anode No | Surface area of bottom face F ($cm^2$) | Distance, clamps to bottom face l (cm) | Current I (A) | Calculated ΔV(calc.) (V) | Measured ΔV(msrd) (V) |
| 452 | 5,19 | 4,9 | 0,8 | 3,0 | 1,5 |
| 457 | 3,05 | 4,0 | 1,5 | 7,9 | 2,0 |
| 456 | 4,30 | 3,6 | 3,6 | 12,0 | 3,0 |
| 455 | 3,94 | 3,6 | 4,7 | 17,2 | 3,5 |

Table III shows that the measured voltage drop is much less than the calculated value. This means that the main part of the current leaves the anode in the region of the three phase boundary whilst only a minor part leaves at the bottom face. This is understandable because the resistance of the cryolite melt is very much smaller than that of the anode. In the case of the cryolite melt used here the specific resistance is 0.4 ohm.cm, that is, about 10 times lower than the specific resistance of the anode. It must be assumed that a whole series of events takes place at the three phase boundary, leading to extensive corrosion there, viz., Very high local current density
Pronounced release of oxygen which produces turbulence both in the liquid and in the gas phase.
local overheating since the thermal conductivity of the ceramic is poor.

d. A minimal amount of corrosion at the three phase boundary is achieved when the current density is very small, for example as with anode 452, however the quality of aluminum obtained was still bad. For the industrial production of aluminum the three phase boundary has to be protected.

This example confirms the results of the prior publications. A reduction plant grade of aluminum can not be produced with ceramic oxide anodes without further measures being taken.

EXAMPLE 3

The samples had the same composition as in example No. 2. In order to protect the three phase boundary the anode was coated with a densely-sintered ring of aluminum oxide. The ring which was about 4 cm high covered the whole of the anode side-wall whilst the bottom face of the anode was freely exposed. The space between the protective ring and the anode was filled with a paste of fine aluminum oxide and sintered.

Table IV shows that anodes with a protective ring but carrying no current also corrode strongly at the unprotected places (Anode 558). If a current density of 0.01 A/$cm^2$ or less is produced there is clearly a reduced but still measurable attack (Anode T 22 and 418). On account of the low current density only a little aluminum precipitated out; however because of the corrosion of the anode there is a relatively large amount of tin, resulting in a very high calculated tin content in the metal produced.

On using a current density of more than 0.01 A/$cm^2$, there was a sharp drop in the corrosion of the bottom face of the anode and thereby a sharp drop in the calculated maximum tin content of the aluminum (Anode 448 ff). No attack whatever could be found on the bottom face of the anode and also the length of the anode was unchanged. However since the accuracy of measurement is 0.1 mm the amount removed from the anode length could be a maximum of 0.1 mm. This maximum value was incorporated in the calculation and therefore only an upper limit to the tin content is given but, as is shown later in example No. 5, this value lies far above the actual value and for this reason has the sign << in front.

TABLE IV

Anode: $SnO_2$ + 2% $Fe_2O_3$, sintered at 1300 – 1500°C for 2 – 5 h
True density: 6,88 g/$cm^2$
Cryolite melt: 1105 g $Na_3AlF_6$ + 65 g $AlF_3$ + 130 g $Al_2O_3$, 960–980°C, + 100g molten Al
Depth of Anode in melt: 2 cm

| Anode (no) | Surface area of bottom face ($cm^2$) | Length (cm) | Apparent density (g/$cm^3$) | % true density | Height of protective ring (cm) | Test duration (h) | Current (A) | Current density (A/$cm^2$) | Aluminum (g/h) | Corrosion of bottom face $SnO_2$ ($cm^3$/h) | Corrosion of bottom face Sn (g/h) | Calculated Sn content in aluminum (%) |
|---|---|---|---|---|---|---|---|---|---|---|---|---|
| 558 | 6,03 | 5,29 | 6,77 | 98,4 | 3,1 | 42 | — | — | — | 0,045 | 0,240 | — |
| T-22 | 6,11 | 5,52 | 6,69 | 97,2 | 2,5 | 43,5 | 0,031 | 0,005 | 0,010 | 0,0086 | 0,0453 | 81,9 |
| 418 | 5,85 | 5,26 | 6,80 | 98,8 | 3,1 | 41 | 0,060 | 0,010 | 0,020 | 0,0083 | 0,0444 | 68,9 |
| 448 | 7,02 | 5,14 | 6,66 | 96,8 | 2,6 | 42 | 0,175 | 0,025 | 0,059 | <<0,0017 | <<0,0089 | <<13,1 |
| 388 | 6,60 | 5,29 | 6,77 | 98,4 | 2,7 | 50 | 0,33 | 0,05 | 0,111 | <<0,0013 | <<0,0069 | <<5,9 |
| 564 | 5,60 | 5,54 | 6,76 | 98,2 | 3,0 | 42 | 1,1 | 0,20 | 0,37 | <<0,0013 | <<0,0071 | <<1.89 |
| 475 | 4,27 | 5,04 | 6,82 | 99,1 | 2,5 | 42 | 2,1 | 0,49 | 0,70 | <<0,0010 | <<0,0054 | <<0,76 |

TABLE IV-continued

| | |
|---|---|
| Anode: | $SnO_2$ + 2% $Fe_2O_3$, sintered at 1300 - 1500°C for 2 - 5 h |
| True density: | 6,88 g/cm² |
| Cryolite melt: | 1105 g $Na_3AlF_6$ + 65 g $AlF_3$ + 130 g $Al_2O_3$, 960–980°C, + 100g molten Al |
| Depth of Anode in melt: | 2 cm |

| Anode (no) | Surface area of bottom face (cm²) | Length (cm) | Apparent density (g/cm³) | % true density | Height of protective ring (cm) | Test duration (h) | Current (A) | Current density (A/cm²) | Aluminum (g/h) | Corrosion of bottom face $SnO_2$ (cm³/h) | Corrosion of bottom face Sn (g/h) | Calculated Sn content in aluminum (%) |
|---|---|---|---|---|---|---|---|---|---|---|---|---|
| 476 | 6,56 | 5,22 | 6,65 | 96,7 | 2,5 | 41 | 7,9 | 1,20 | 2,65 | <<0,0016 | <<0,0084 | <<0,32 |

<<Amount removed lower than accuracy of measurement

Table V shows a comparison of the measured drop with the calculated drop in potential.

TABLE V

Depth of Anode in melt: 2 cm

| Anode No | Surface area of bottom face F (cm²) | Distance clamps to bottom face l (cm) | Current I (A) | Voltage drop Calculated ΔV(calc.) (V) | Voltage drop Measured ΔV(msrd) (V) |
|---|---|---|---|---|---|
| 564 | 5,60 | 3,2 | 1,1 | 2,5 | 3,0 |
| 475 | 4,27 | 3,3 | 2,1 | 6,5 | 5,7 |
| 476 | 6,56 | 3,0 | 7,9 | 14,4 | 12,0 |

The relatively good agreement between the calculated and the measured voltage drop shows that, thanks to the protective ring, the current really does flow into the cryolite melt from the bottom face of the anode.

EXAMPLE 4

In the previous examples Nos. 2 and 3, experiments with anodes of $SnO_2$ — $Fe_2O_3$ were described. This system has, however, the disadvantage that as a result of the relatively high specific resistance of the ceramic there is a correspondingly large drop in voltage and this then incurs a high energy expenditure in the production of aluminum. In this example a densely sintered ceramic with a lower specific resistance of the order of magnitude which can be found with anode carbon, is used:

| | | |
|---|---|---|
| $SnO_2$ + 0.3% $MnO_2$ | 0.1 | Ohm.cm (at 1000°C) |
| $SnO_2$ + 2% CuO + 1% $Sb_2O_3$ | 0.004 | " |

These values are to be compared with the following specific resistivities:

| | | |
|---|---|---|
| Anode carbon | 0.005 | Ohm.cm (at 1000°C) |
| Cryolite melt | 0.4 | " |
| $SnO_2$ + 2% $Fe_2O_3$ | 4 | " |

Table VI shows that also in the case of a good conducting ceramic the three phase boundary plays an important role in anode corrosion (Anodes 504 and 567). Only when the anode is protected in the region of the three phase boundary (Anodes 506 and 566), can the corrosion be reduced to zero (within the limits of accuracy of measurement).

EXAMPLE 5

By way of contrast to the examples 2–4 this example concerns effectively a production experiment. Since no aluminum was added to the melt at the start of the experiment the aluminum produced in the experiment itself could be analysed. In particular the exact tin content of the aluminum obtained could be determined and compared with the calculated values.

The samples had the same composition as in examples 2 and 3 i.e. 98% $SnO_2$ and 2% $Fe_2O_3$. To protect the three phase zone on one anode it was covered as described in example No. 3, with a protective ring of densely sintered aluminum oxide, whilst the other anode was put into the bath without any protection.

TABLE VI

| | |
|---|---|
| Anode Nos 504 and 506: | $SnO_2$ + 2% CuO + 1% $Sb_2O_3$, sintered at 1200°C for 2 h<br>True density: 6,91 g/cm³ |
| Anode Nos 566 and 567: | $SnO_2$ + 0,3% $MnO_2$, sintered at 1300°C for 2 h<br>True density: 6,94 g/cm³ |
| Cryolite melt: | 1105g $Na_3AlF_6$ + 65g $AlF_3$ + 130g $Al_2O_3$, 960 - 980°C, over 100g molten Al |

| Anode No | Area of Bottom face (cm²) | Length (cm) | Apparent Density * The (g/cm³) | % True Density ring | Height of protective melt (cm) | Anode Depth in test (cm) | Dura- 0,0011 of (h) | Current (A) | Current density (A/cm²) |
|---|---|---|---|---|---|---|---|---|---|
| 504 | 4,79 | 4,50 | 6,63 | 95,9 | — | 2,0 | 42 | 1,9 | 0,40 |
| 506 | 4,64 | 4,95 | 6,58 | 95,2 | 3,7 | 2,0 | 50 | 1,8 | 0,39 |
| 567 | 4,75 | 7,21 | 6,91 | 99,6 | — | 3,0 | 42 | 2,0 | 0,42 |
| 566 | 4,79 | 7,75 | 6,90 | 99,4 | 4,1 | 3,0 | 43,5 | 1,9 | 0,40 |

| Anode No | Aluminum (g/h) | Corrosion of Bottom face $SnO_2$ (cm³/h) | Corrosion of Bottom face Sn (g/h) | Corrosion of the 3-phase zone $SnO_2$ (cm³/h) | Corrosion of the 3-phase zone Sn (g/h) | Total Corrosion Sn (g/h) | Calculated tin content in Al % |
|---|---|---|---|---|---|---|---|
| 504 | 0,64 | * | * | * | * | 0,6276 | 4,15 |
| 506 | 0,60 | <<0,0009 | <<0,0048 | | | <<0,0048 | <<0,79 |
| 567 | 0,67 | <<0,0011 | <<0,0062 | 0,00258 | 0,0140 | 0,0202 | 2,92 |

TABLE VI-continued

| | |
|---|---|
| Anode Nos 504 and 506: | $SnO_2$ + 2% CuO + 1% $Sb_2O_3$, sintered at 1200°C for 2 h<br>True density: 6,91 g/cm³ |
| Anode Nos 566 and 567: | $SnO_2$ + 0,3% $MnO_2$, sintered at 1300°C for 2 h<br>True density: 6,94 g/cm³ |
| Cryolite melt: | 1105g $Na_3AlF_6$ + 65g $AlF_3$ + 130g $Al_2O_3$, 960 – 980°C, over 100g molten Al |

| Anode No | Area of Bottom face (cm²) | Length (cm) | Apparent Density * The (g/cm³) | % True Density ring | Height of protective melt (cm) | Anode Depth in test (cm) | Dura- 0,0011 of (h) | Current (A) | Current density (A/cm²) |
|---|---|---|---|---|---|---|---|---|---|
| | 566 | 0,64 | <<0,0011.<br><<0,0062 | | | <<0,00-62 | | <<0,93 | |

*The corrosion cannot be straight forwardly divided between the bottom and the three phase zone in these cases since the removal of anode material left a conical shape at the bottom.
<<Amount removed less than determinable by the accuracy of measurement.

In order to provide a sufficient reserve of alumina and at the same time to prevent the reoxidation of precipitated aluminum the inside wall of the graphite crucible was coated with a paste of reduction plant grade alumina which was then dried at 200°C. The bottom of the graphite crucible served as the cathode.

Table VII contains the collected experimental parameters, and the calculated and measured results.

After the experiment the anode AH-3 (with protected three phase zone) showed no sign of attack whatever, whilst the AH-7 anode (without protection) had been strongly attacked. The tin and iron contents of the precipitated aluminum was determined spectrochemically. The table shows that the measured tin content from the experiment AH-7 (unprotected three phase zone) was unacceptably high, whereas in the case of the experiment AH-3 (with protected three phase zone) the tin and iron content is very low and the aluminum produced conformed completely with the specifications for a normal reduction plant grade.

By comparing the calculated values and the values obtained by analysis it can be seen that the calculated upper limit for the tin content is much too high, in particular in the case of small degrees of impurity. This fact must also be taken into consideration when judging the calculated maximum tin concentrations in aluminum in tables IV and VI; the values given there can likewise be far above the actual tin content.

What we claim is:

1. In a process for operating a cell for the electrolysis of a molten charge containing aluminum oxide, the cell being of the type including at least one anode, the steps comprising:

using a non-consumable anode having a working surface of ceramic oxide material to be at least partially in contact with the molten charge, and maintaining a current density above a predetermined minimum value over that part of the anode surface in contact with the molten charge.

2. Process according to claim 1, in which the minimum current density is 0.005 A/cm².

TABLE VII

| | | |
|---|---|---|
| Anode: | $SnO_2$ + 2% $Fe_2O_3$, sintered at 1450°C for 1h | |
| True density: | 6,88 g/cm³ | |
| Cryolite melt: | AH-3: | 884 g $Na_3AlF_6$ + 52 g $AlF_3$ + 104 g $Al_2O_3$<br>400 g aluminum oxide (reduction plant grade) on the crucible wall, 960–980°C, no aluminum added. |
| | AH-7: | 995 g $Na_3AlF_6$ + 59 g $AlF_3$ + 117 g $Al_2O_3$<br>300 g aluminum oxide (reduction plant grade) on the crucible wall, 960–980°C, no aluminum added. |

| Anode | with protective ring AH-3 | without protective ring AH-7 |
|---|---|---|
| Area of bottom face (cm²) | 9,90 | 16,91 |
| Length (cm) | 4,71 | 5,76 |
| Apparent density (g/cm³) | 6,67 | 6,50 |
| % true density | 96,9 | 94,5 |
| Height of protective ring (cm) | 3,0 | — |
| Depth of anode in melt (cm) | 2,5 | 3,0 |
| Duration of test (h) | 65 | 61 |
| Current density (A/cm²) | 0,27 | 0,72 |
| Corrosion: - $SnO_2$ (cm³/h) | <<0,0015 | 0,043 |
| -Sn (g/h) | <<0,0080 | 0,218 |
| Calculated tin content of Al (%) | <<0,875 | 5,06 |
| Aluminum obtained | | |
| theoretical (g/h) | 0,905 | 4,09 |
| measured, after experiment | | |
| collected on crucible bottom (g) | 9,5 | 44 |
| remaining in the bath (g) | 2,05 | 1,8 |
| Current yield (%) | 19,6 | 18,3 |
| Analysis of the precipitated Al | | |
| tin content (%) | 0,05–0,1 | 12 |
| iron content (%) | 0,1 | 0,3 |
| Tin content extrapolated to a yield of 100% | 0,0098–0,0196 | 2,1 |

<<Amount removed less than accuracy of measurement.

3. Process according to claim 2, in which the minimum current density is 0.01 $A/cm^2$.

4. Process according to claim 3, in which the minimum current density is 0.025 $A/cm^2$.

5. Process according to claim 1, in which the composition of the molten charge comprises cryolite.

6. Process according to claim 1, in which the composition of the molten charge comprises oxides.

7. In a process as claimed in claim 1, and providing the anode, at least in the three phase interface region where the atmosphere and the molten charge surface are in contact, with a protective layer of an electrically insulating material resistant to attack by the molten charge.

8. A process as claimed in claim 7, wherein the sides of the anode are protected by said protective coating comprising solidified molten charge, at least in the region of the three phase zone.

9. In a process as claimed in claim 8, wherein the step of providing the anode with a protective layer comprises inducing localized cooling on the anode surface to solidify the molten charge.

10. A process, as claimed in claim 7, comprising the step of providing said layer before electrolysis is commenced.

* * * * *